US008274469B2

(12) United States Patent
Takahashi

(10) Patent No.: US 8,274,469 B2
(45) Date of Patent: Sep. 25, 2012

(54) DISPLAY DEVICE THAT CONTROLS GRADATION OF DISPLAY IMAGE, AND METHOD FOR CONTROLLING THE GRADATION OF DISPLAY IMAGE

(75) Inventor: Nariya Takahashi, Chino (JP)

(73) Assignee: Seiko Epson Corporation, Tokyo (JP)

( * ) Notice: Subject to any disclaimer, the term of this patent is extended or adjusted under 35 U.S.C. 154(b) by 1248 days.

(21) Appl. No.: 12/037,285

(22) Filed: Feb. 26, 2008

(65) Prior Publication Data

US 2008/0231587 A1 Sep. 25, 2008

(30) Foreign Application Priority Data

Mar. 23, 2007 (JP) ..... 2007-076109

(51) Int. Cl.
*G09G 3/36* (2006.01)

(52) U.S. Cl. ..... 345/101

(58) Field of Classification Search ..... 345/60–72, 345/87–101, 691–694; 349/72, 199
See application file for complete search history.

(56) References Cited

U.S. PATENT DOCUMENTS

| | | | | |
|---|---|---|---|---|
| 7,002,537 | B1 | 2/2006 | Ito | |
| 2004/0196233 | A1 * | 10/2004 | Shimizu | 345/89 |
| 2008/0284707 | A1 * | 11/2008 | Katagawa et al. | 345/96 |

FOREIGN PATENT DOCUMENTS

| | | |
|---|---|---|
| JP | A-2002-062857 | 2/2002 |
| JP | A 2003-114661 | 4/2003 |

* cited by examiner

*Primary Examiner* — Sumati Lefkowitz
*Assistant Examiner* — Rodney Amadiz
(74) *Attorney, Agent, or Firm* — Oliff & Berridge, PLC

(57) ABSTRACT

The invention relates to a display device that preforms gradation display. The display device comprising: a display area in which a plurality of pixels is arrayed, a first storing section that stores a gradation that is to be displayed, a first converting section that looks up the first storing section so as to convert an image signal into a first sub-field data, a temperature-data acquiring section that acquires a temperature of the display area; a second storing section that stores a temperature of the display area, a second converting section that looks up the second storing section so as to convert the temperature into a second sub-field data, a combining section that combines the first sub-field data and the second sub-field data, and a driving section that controls an ON/OFF state for each of the plurality of pixels on the basis of the combined sub-field data.

1 Claim, 8 Drawing Sheets

142

| | HIGH GRADATION RANGE | MEDIUM GRADATION RANGE | LOW GRADATION RANGE |
|---|---|---|---|
| 40°C | 011 | 000 | 000 |
| 50°C | 001 | 011 | 000 |
| 60°C | 000 | 111 | 000 |

DISPLAY DEVICE THAT CONTROLS GRADATION OF DISPLAY IMAGE, AND METHOD FOR CONTROLLING THE GRADATION OF DISPLAY IMAGE

BACKGROUND

1. Technical Field

The present invention relates to a display device that controls gradation display by means of a sub-field driving scheme. In addition, the invention relates to a method for driving such a display device. Moreover, the invention further relates to an electronic apparatus that is provided with such a display device.

2. Related Art

In the technical field to which the invention pertains, a liquid crystal device is widely used as the display device of a variety of electronic apparatuses. A typical liquid crystal device of the related art displays an image as the result of a change in the optical transmission factor of the liquid crystal thereof. A few non-limiting examples of such a variety of electronic apparatuses having the liquid crystal device as its display unit include an information processing device, a television, and a mobile phone. A liquid crystal device of the related art is, in the typical configuration thereof, provided with a plurality of pixel electrodes each of which is provided at the intersection formed by a scanning line, which extends in a row direction, and a data line, which extends in a column direction. A pixel-switching element such as a thin film transistor (TFT) or the like is provided at a position corresponding to each of the intersections formed by a plurality of scanning lines and a plurality of data lines. Specifically, a TFT pixel-switching element is interposed between the pixel electrode and the data line in such a manner that it corresponds to each of these intersections. On the basis of a scanning signal that is supplied via the corresponding scanning line, the TFT pixel-switching element switches over the ON/OFF state of a connection therebetween. A counter electrode is provided opposite the pixel electrode with the liquid crystal being sandwiched between the counter electrode and the pixel electrode. When a voltage is applied between the pixel electrode and the counter electrode in accordance with the gradation of an image signal, the orientation state, that is, the alignment state, of the liquid crystal changes in accordance with the level of the voltage applied thereto. As a result thereof, the amount of light that passes through the liquid crystal at the corresponding pixel changes so as to enable a desired gradation display.

In the typical configuration of a liquid crystal device of old conventional art, an image signal that is applied to the data line has a voltage format that corresponds to gradation, that is, the signal format of an analog signal. For this reason, a liquid crystal device of such old conventional art requires a D/A conversion circuit, an operational amplifier, and the like, as the peripheral circuit components thereof. Such a configuration is disadvantageous not only in that the production cost thereof is relatively high but also in that it is practically impossible, or at best difficult, to display an image in a uniform manner. As an effort to provide a technical solution to such a conventional problem, these days, a sub-field driving scheme is proposed. The sub-field driving scheme adopts a digital format for the driving of liquid crystal. Specifically, in a typical sub-field driving scheme, each one field is divided into a plurality of sub fields on a time axis. In each of the plurality of sub fields, either an ON signal or an OFF signal is applied depending on the gradation of each of pixels. Such a sub-field driving scheme is described in, for example, JP-A-2003-114661.

Specifically, JP-A-2003-114661 discloses a technique of displaying an image with gradation that is finer than the number of sub fields that are contained in one field, which is achieved by fine-controlling the change in the optical transmission factor of the liquid crystal in each sub field. Assuming that the number of sub fields that make up one field is denoted as "n", the number of gradations obtained under a usual pulse-width control is limited to (n+1). Under the usual pulse-width control, each field has a pattern in which ON sub fields follow one after another. In contrast, according to the above-identified art that is described in JP-A-2003-114661, since OFF sub fields are mixed therein, it is possible to represent/display gradations the number of which is considerably larger than (n+1), which is available under the usual pulse-width control.

As a reference for converting the gradation of display-target image data into sub-field data, a lookup table is used. A lookup table is a table that shows the gradation of a display-target image (e.g., gradation represented in eight bits) and the ON/OFF pattern of sub fields (e.g., thirty-two sub fields that make up one field) in association with each other. In such a lookup table, as the sub-field ON/OFF pattern thereof, a pattern that is suitable for representing gradation has been obtained in advance theoretically and empirically, that is, by way of an experiment, in accordance with the characteristics of liquid crystal or the like.

In connection therewith, generally speaking, the characteristics of liquid crystal changes depending on temperature. FIG. 12 is a graph that illustrates an example of the characteristics of liquid crystal, specifically, the relation between gradation and optical transmission factor thereof under a plurality of temperature conditions. In the illustrated example, the temperature of a liquid crystal panel is assumed to be 40° C., 50° C., and 60° C. As understood from characteristic curves shown therein, the characteristics of a liquid crystal under one temperature condition differ from that of another. For this reason, image data having the same single gradation could be displayed with brightness levels that are different from one another depending on temperature conditions.

In order to correct variations/differences in the optical-transmission-factor characteristics of liquid crystal that are attributable to variations/differences in temperature conditions so as to obtain a uniform display, it is necessary to preset, and store in a memory, a set of a plurality of lookup tables so as to correspond to a plurality of actual temperature conditions. This inevitably requires a large memory capacity.

SUMMARY

An advantage of some aspects of the invention is to provide a display device that is capable of correcting the temperature characteristics of liquid crystal without requiring any large memory capacity in a sub-field data conversion lookup table. In addition, the invention provides, as an advantage of some aspects thereof, a method for driving such a display device. Moreover, the invention further provides, as an advantage of some aspects thereof, an electronic apparatus that is provided with such a display device.

In order to address the above-identified problem without any limitation thereto, the invention provides, as a first aspect thereof, a display device that performs gradation display by means of a sub-field driving scheme, the display device including: a display area (for example, the image display area 111 that is shown in FIG. 1, though not limited thereto) in which a plurality of pixels is arrayed, the display device controlling an ON/OFF state for each of the plurality of pixels for each of a plurality of sub fields that make up one field, one part of the plurality of sub fields constituting a first time period, the other part of the plurality of sub fields constituting a second time period; a first storing section (for example, the lookup table 132 that is shown in FIG. 7, though not limited thereto) that pre-stores, for each of the sub fields that belong to the first time period, a gradation that is to be displayed and an ON/OFF state of the pixel in association with each other; a first converting section (for example, the digital signal sub-field conversion circuit 130 that is shown in FIG. 7, though not limited thereto) that looks up the first storing section so as to convert an image signal that indicates a gradation that is to be displayed into a first sub-field data that specifies an ON/OFF state of the pixel for each of the sub fields that belong to the first time period; a temperature-data acquiring section (for example, the temperature sensor 150 that is shown in FIG. 1, though not limited thereto) that acquires a temperature of the display area; a second storing section (for example, the temperature characteristic correction sub-field table 142 that is shown in FIG. 7, though not limited thereto) that pre-stores, for each of the sub fields that belong to the second time period, a temperature of the display area and an ON/OFF state of the pixel in association with each other; a second converting section (for example, the temperature correction circuit 140 that is shown in FIG. 7, though not limited thereto) that looks up the second storing section so as to convert the temperature acquired by the temperature-data acquiring section into a second sub-field data that specifies an ON/OFF state of the pixel for each of the sub fields that belong to the second time period; a combining section (for example, the digital signal sub-field conversion circuit 130 that is shown in FIG. 7, though not limited thereto) that combines the first sub-field data and the second sub-field data so as to generate a combined sub-field data that specifies an ON/OFF state for each of the plurality of sub fields that make up one field; and a driving section (for example, the data-line driver 113 that is shown in FIG. 1, though not limited thereto) that controls an ON/OFF state for each of the plurality of pixels for each of the plurality of sub fields on the basis of the combined sub-field data.

If a gradation that is to be displayed is assigned to each of sub fields to perform temperature correction, it is necessary to pre-store a gradation that is to be displayed and an ON/OFF state of each of sub fields in association with each other for every temperature. Such a configuration is disadvantageous in that it inevitably increases memory capacity. In contrast, with the configuration of a display device according to the first aspect of the invention described above, one field is divided up into a first time period, which is made up image-display sub fields, and a second time period, which is made up of temperature-correction sub fields, for independent driving thereof. With such a data-field configuration, the first sub-field data, which controls sub fields that belong to the first time period, is independent of temperature. Therefore, it is not necessary to prepare an individual table for each temperature. Thus, it is possible to significantly reduce the memory capacity (i.e., storage occupancy) of the first storing section.

A typical example of the display device according to the first aspect of the invention is a liquid crystal device that uses liquid crystal, though not necessarily limited thereto. Generally speaking, the optical transmission factor of liquid crystal changes depending on temperature. Therefore, the controlling of an ON/OFF state of a pixel in accordance with temperature makes it possible to display gradation with a high precision. Another non-limiting example of the display device according to the first aspect of the invention is an electro-optical device that uses an electro-optical element that changes its optical characteristics depending on an electric energy. A non-limiting example of such an electro-optical device is a light-emitting diode that includes an organic light-emitting diode and an inorganic light-emitting diode. In the configuration of a display device according to the first aspect of the invention, a temperature sensor may be provided, for example, in the proximity of the display area so as to acquire the temperature of the display area thereof. Alternatively, a temperature sensor may be built in the display area so as to acquire the temperature of the display area thereof, though not limited thereto.

In the configuration of a display device according to the first aspect of the invention described above, it is preferable that the second storing section should pre-store, for each of the sub fields that belong to the second time period, a temperature of the display area and an ON/OFF state of the pixel in association with each other for each of a plurality of gradation ranges that constitute divided parts of a gradation; and the second converting section should identify a gradation range to which a gradation that is to be displayed belongs on the basis of the image signal and then should read the second sub-field data that corresponds to the identified gradation range out of the second storing section. With such a preferred configuration, it is possible to control an ON/OFF state thereof in consideration of gradation-range characteristics. Therefore, such a preferred configuration makes it possible to display gradation with an enhanced precision when pixel-brightness temperature characteristics change depending on a gradation that is to be displayed.

In the configuration of a display device according to the first aspect of the invention described above, it is preferable that the plurality of sub fields should constitute time-divided sub-units of one field.

In order to address the above-identified problem without any limitation thereto, the invention provides, as a second aspect thereof, an electronic apparatus that is provided with a display device according to the first aspect of the invention. A few examples of a variety of electronic apparatuses according to the second aspect of the invention include but not limited to an image display unit, a mobile phone, and a personal computer.

In order to address the above-identified problem without any limitation thereto, the invention provides, as a third aspect thereof, a method for driving a display device that performs gradation display by means of a sub-field driving scheme, the display device having a display area in which a plurality of pixels is arrayed, the display device controlling an ON/OFF state for each of the plurality of pixels for each of a plurality of sub fields that make up one field, one part of the plurality of sub fields constituting a first time period, the other part of the plurality of sub fields constituting a second time period, the driving method including: controlling an ON/OFF state of the pixel in accordance with a gradation that is to be displayed for each of the sub fields that belong to the first time period; and controlling an ON/OFF state of the pixel in accordance with a temperature of the display area for each of the sub fields that belong to the second time period. In the display-device driving method according to the third aspect of the invention described above, one field is divided up into a first time period, which is made up image-display sub fields, and a second time period, which is made up of temperature-correction sub fields, for independent driving thereof. With such a data-field configuration, the first sub-field data, which controls sub fields that belong to the first time period, is independent of temperature. Therefore, it is not necessary to perform signal-to-data conversion in consideration of a temperature factor.

In the display-device driving method according to the third aspect of the invention described above, it is preferable that, for each of the sub fields that belong to the second time period, an ON/OFF state of the pixel should be controlled in accordance with a temperature of the display area and a gradation range to which a gradation that is to be displayed belongs among a plurality of gradation ranges that constitutes divided parts of a gradation. With such a preferred method, it is possible to control an ON/OFF state thereof in consideration of gradation-range characteristics. Therefore, such a preferred method makes it possible to display gradation with an enhanced precision when pixel-brightness temperature characteristics change depending on a gradation that is to be displayed.

BRIEF DESCRIPTION OF THE DRAWINGS

The invention will be described with reference to the accompanying drawings, wherein like numbers reference like elements.

DESCRIPTION OF EXEMPLARY EMBODIMENTS

Exemplary Embodiments

Figure 1:
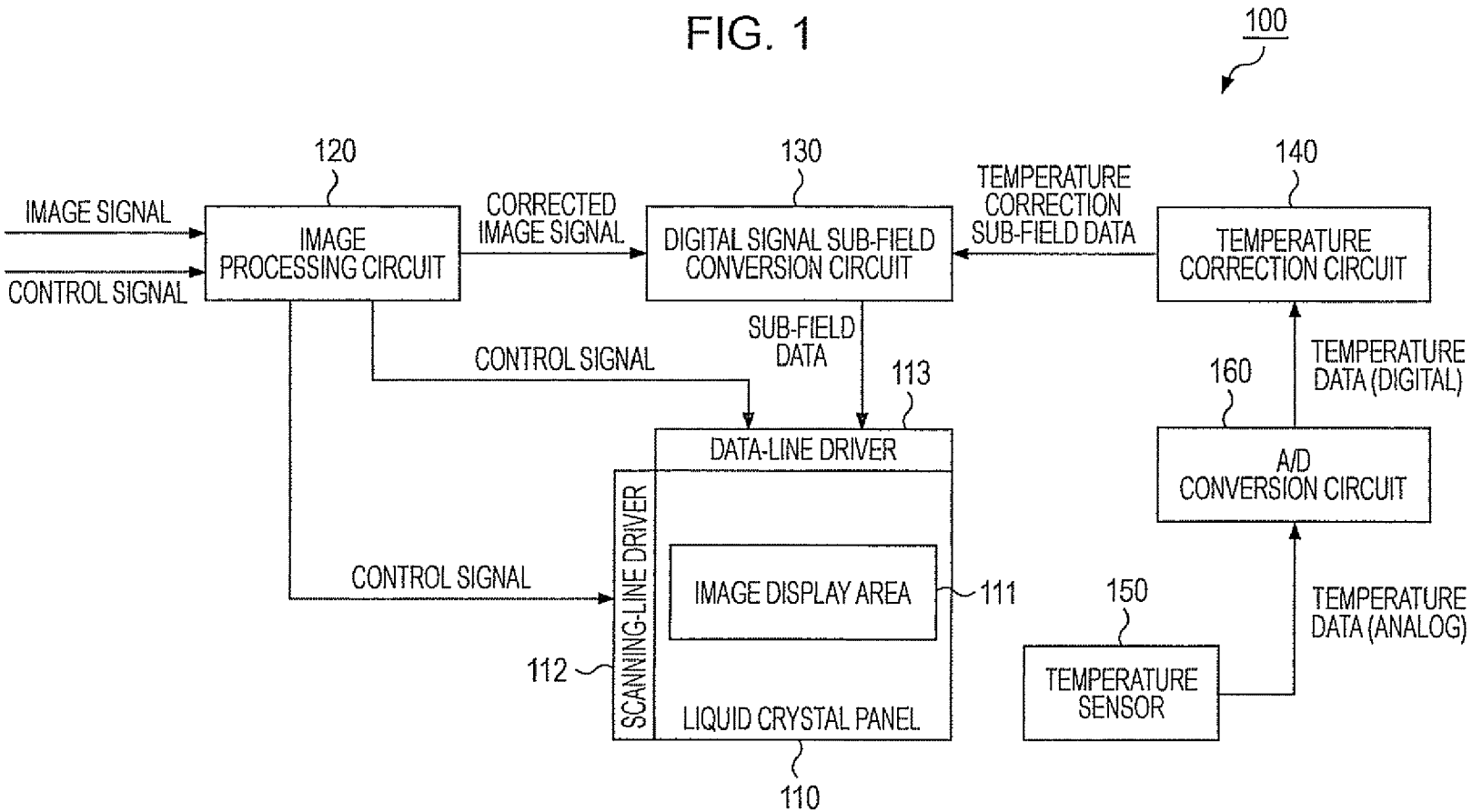
FIG. 1 is a block diagram that schematically illustrates an example of the general configuration of a liquid crystal device according to an exemplary embodiment of the invention.

FIG. 1 is a block diagram that schematically illustrates an example of the general configuration of a liquid crystal device according to an exemplary embodiment of the invention. A liquid crystal device 100 employs liquid crystal as its electro-optical material. The liquid crystal device 100 is provided with a liquid crystal panel 110, which constitutes the main component thereof. The liquid crystal panel 110 of the liquid crystal device 100 is mainly made up of an element substrate and a counter substrate. The element substrate and the counter substrate are provided opposite each other in such a manner that the electrode formation surface of the element substrate faces the electrode formation surface of the counter substrate. The element substrate has switching elements formed thereon. A non-limiting example of the switching element is a thin film transistor (TFT). The element substrate and the counter substrate are adhered to each other by means of a sealant with a predetermined gap space being interposed therebetween. Liquid crystal is sandwiched at, that is, sealed in, the gap space between the element substrate and the counter substrate. In the present embodiment of the invention, it is assumed that the liquid crystal device 100 operates in a sub-field driving scheme. Under the sub-field driving scheme, it should be noted that the length of a plurality sub fields that make up one field is the same with each other.

The liquid crystal device 100 is provided with an image processing circuit 120, a digital signal sub-field conversion circuit 130, a temperature correction circuit 140, a temperature sensor 150, and an A/D conversion circuit 160. An image display area 111, a scanning-line driver 112, and a data-line driver 113 are formed on the element substrate of the liquid crystal panel 110.

An analog-format image signal and a control signal are supplied from an external device, which is not shown in the drawing, to the image processing circuit 120. The image processing circuit 120 converts an analog-format image signal to a digital-format image signal. Then, the image processing circuit 120 performs a series of image processing that includes but not limited to gamma correction, liquid-crystal-panel unevenness correction, and liquid-crystal-panel variation correction. Thereafter, the image processing circuit 120 supplies the "corrected" image signal after the series of image processing described above to the digital signal sub-field conversion circuit 130. On the other hand, the image processing circuit 120 outputs a control signal to each of the scanning-line driver 112 and the data-line driver 113 so as to control these line drivers. A few non-limiting examples of the control signal include a horizontal scanning signal and a vertical scanning signal.

The temperature sensor 150 is provided in the proximity of the liquid crystal panel 110. The temperature sensor 150 measures the temperature of the liquid crystal panel 110 either directly or indirectly so as to acquire temperature data thereof. The temperature data acquired by the temperature sensor 150, which is analog data, is converted into digital data by the A/D conversion circuit 160. Then, the A/D converted temperature data is sent to the temperature correction circuit 140. The temperature sensor 150 may be constituted as a TFT and built in the image display area 111. As will be described in detail later, the temperature correction circuit 140 supplies sub-field correction data that corresponds to the measured temperature to the digital signal sub-field conversion circuit 130. In order to simplify explanation, it is assumed in the following description of exemplary embodiments of the invention that temperature data is made up of a discrete temperature set of 40° C., 50° C., and 60° C.

The digital signal sub-field conversion circuit 130 refers to a lookup table that is stored either inside or outside thereof so as to convert the aforementioned corrected image signal, which has been supplied thereto from the image processing circuit 120, into image sub-field data. Then, the digital signal sub-field conversion circuit 130 combines the image sub-field data with temperature-correction sub-field data, which has been supplied thereto from the temperature correction circuit 140, so as to generate sub-field data. Thereafter, the digital signal sub-field conversion circuit 130 supplies the generated sub-field data to the data-line driver 113. As will be described in detail later, in the field configuration of the liquid crystal device 100 according to the present embodiment of the invention, it is assumed that one field is made up of thirty-two sub fields. Among these thirty-two sub fields, twenty-nine thereof are used as image-display sub fields, whereas the remaining three thereof are used as temperature-correction sub fields. The sub-field data indicates, that is, specifies, pixel ON/OFF for each of these thirty-two sub fields. Specifically, the image sub-field data indicates pixel ON/OFF for each of twenty-nine image-display sub fields described above, whereas the temperature-correction sub-field data indicates pixel ON/OFF for each of three temperature-correction sub fields described above. A more detailed explanation of the above-described processing will be given later.

Figure 2:
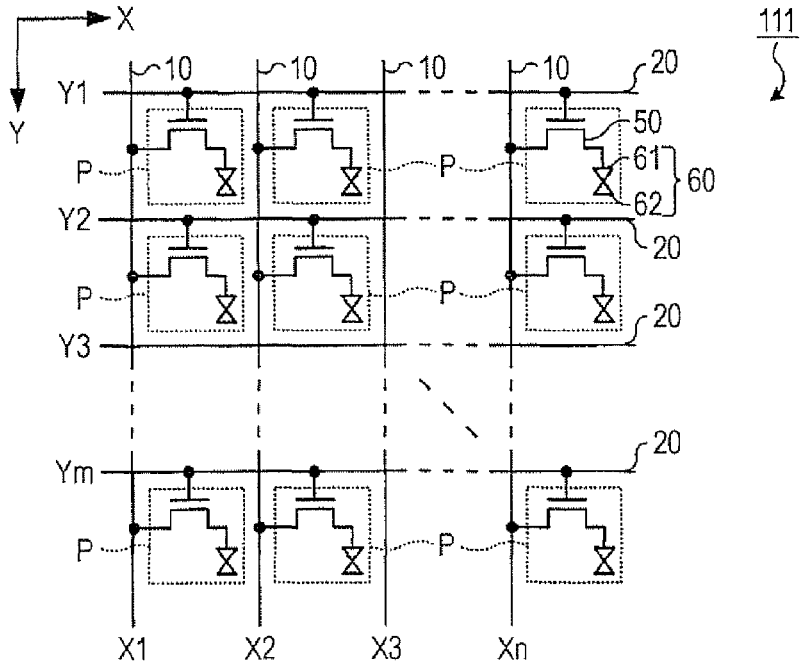
FIG. 2 is a circuit diagram that illustrates an example of the configuration of the image display area of a liquid crystal device according to an exemplary embodiment of the invention.

FIG. 2 is a circuit diagram that illustrates an example of the configuration of the image display area 111 of the liquid crystal panel 110. On one hand, the "m" number (note that "m" is a natural number that is greater than two, or, at the smallest, equal to two) of scanning lines 20 is arrayed in parallel with one another in such a manner that each thereof extends in the X direction in the image display area 111 of the liquid crystal panel 110. On the other hand, the "n" number (note that "n" is also a natural number that is greater than two, or, at the smallest, equal to two) of data lines 10 is arrayed in parallel with one another in such a manner that each thereof extends in the Y direction in the image display area 111 of the liquid crystal panel 110. A plurality of pixel circuits P is arrayed in the image display area 111 of the liquid crystal panel 110 in a matrix that is made up of the "m" rows of the scanning lines 20 and the "n" columns of the data lines 10. These pixel circuits P are provided at positions corresponding to the intersections formed by the "m" rows of the scanning lines 20 and the "n" columns of the data lines 10; that is, each of the pixel circuits P is provided at a position corresponding to the intersection formed by the scanning line 20 and the data line 10.

As illustrated in FIG. 2, each of the plurality of pixel circuits P is provided with a liquid crystal element 60 and a TFT 50. The liquid crystal element 60 is made up of a pixel electrode 61 and a counter electrode 62 with liquid crystal being sandwiched therebetween. A common electric potential, that is, a common voltage, Vcom is supplied to the counter electrode 62 of the liquid crystal element 60. The gate electrode of the TFT 50 is electrically connected to the scanning line 20. Either the source electrode of the TFT 50 or the drain electrode thereof is electrically connected to the data line 10, whereas the other electrode thereof is electrically connected to the pixel electrode 61 of the liquid crystal element 60.

The data-line driver 113, which is illustrated in FIG. 1, outputs data signals X1, X2, X3, . . . , Xn to the "n" number of data lines 10, respectively. Generally speaking, a typical liquid crystal device of the related art is operated under an AC driving method. It is assumed herein that the liquid crystal device 100 according to the present embodiment of the invention is driven under a combination of a line-based current alternation and a frame-based current alternation. In the line-based current alternation, the polarity of a voltage that is applied to liquid crystal is reversed on a line-by-line basis. On the other hand, in the frame-based current alternation, the polarity of a voltage that is applied to liquid crystal is reversed on a frame-by-frame basis. Notwithstanding the foregoing, needless to say, the liquid crystal device 100 may be operated in not a combination thereof but either one of the line-based current alternation and the frame-based current alternation. Alternatively, the liquid crystal device 100 may be operated in a driving scheme other than any of these specific AC driving methods, which should be understood as mere examples and thus do not limit the scope of the invention.

The scanning-line driver 112, which is also illustrated in FIG. 1, is configured to supply scanning signals Y1, Y2, Y3, . . . , and Ym to the "m" number of scanning lines 20 respectively in a pulse-like line-sequential manner. With such a line/circuit configuration, when a scanning signal is supplied to a certain scanning line 20, the TFT 50 of each of the pixel circuits P that belong to the corresponding row thereof enters an ON state. As the TFT 50 is turned ON, a data signal that is supplied via the corresponding data line 10 is written into the corresponding liquid crystal element 60. The orientation of liquid crystal and/or the order of molecular association thereof change depending on the level of a voltage that is applied thereto at each pixel. By this means, it becomes possible to modulate light so as to realize a gradation display.

For example, the amount of light that passes through liquid crystal decreases as the integration of a voltage applied thereto increases in a so-called normally white mode. In contrast thereto, the amount of light that passes through liquid crystal increases as the integration of a voltage applied thereto increases in a so-called normally black mode. Therefore, taken as a whole, light having a contrast in accordance with an image signal is emitted at each of the pixels of the liquid crystal device 100.

It is assumed herein that the liquid crystal device 100 according to the present embodiment of the invention operates in the normally white mode. Therefore, the optical transmission factor of liquid crystal is relatively high when the integration of a voltage applied thereto is relatively small, which results in a relatively white display, whereas the optical transmission factor of liquid crystal is relatively low when the integration of a voltage applied thereto is relatively large, which results in a relatively black display. In order to prevent the leakage of a retained image signal, a retention volume, that is, hold capacitor, may be added in parallel with a liquid crystal capacitance that is formed between the pixel electrode 61 and the counter electrode 62.

Figure 3:
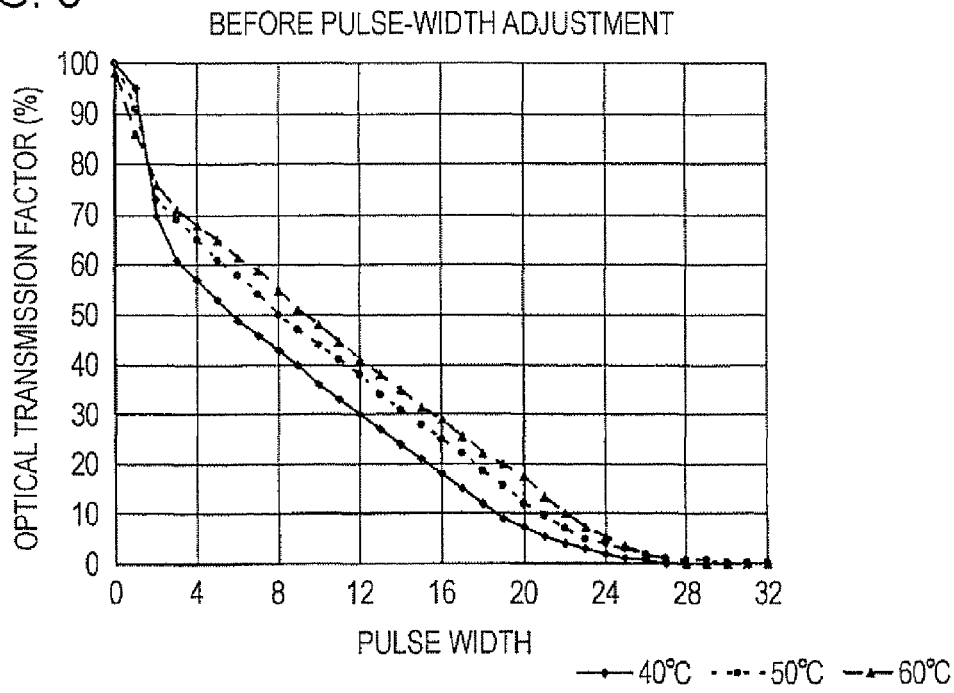
FIG. 3 is a graph that shows the relationship between the pulse width of a voltage that is applied to a liquid crystal element and the optical transmission factor of liquid crystal, which is shown for each of exemplary set of temperatures, before the application of correction according to an exemplary embodiment of the invention.

Next, an explanation is given below of temperature correction according to an exemplary embodiment of the invention. First of all, the temperature characteristics of a liquid crystal element observed under a sub-field driving operation are explained. FIG. 3 is a graph that shows the relationship between the pulse width of a voltage that is applied to a liquid crystal element (60) and the optical transmission factor of liquid crystal, which is shown for each of exemplary temperature set of 40° C., 50° C., and 60° C. It should be noted that FIG. 3 shows characteristic curves obtained before the application of temperature correction according to an exemplary embodiment of the invention. As understood from this graph, the optical transmission factors of liquid crystal differ from one to another depending on temperature even under an assumption that a voltage having the same single pulse width is applied to a liquid crystal element. For example, assuming that a voltage having the pulse width of 12 is applied to a liquid crystal element, the optical transmission factor of liquid crystal is approximately 30% under 40° C. On the other hand, under the same assumption as above, the optical transmission factors of liquid crystal are approximately 38% and 41% under 50° C. and 60° C., respectively.

In addition, it is further understood from characteristic curves shown in FIG. 3 that the temperature-dependent relationships between the pulse width of a voltage that is applied to a liquid crystal element and the optical transmission factor of liquid crystal, or more specifically, the relationships between the optical transmission factor of liquid crystal and temperature, vary from one to another depending on the range of gradation. For example, as understood from characteristic curves shown in FIG. 3, in a medium (e.g., middle or halftone) gradation region (i.e., gradation range) where the pulse width of a voltage that is applied to a liquid crystal element ranges from, for example, three inclusive to 24 inclusive, the optical transmission factor of liquid crystal is relatively high under a relatively high temperature. In contrast, in a high gradation region (i.e., gradation close to white) where the pulse width of a voltage that is applied to a liquid crystal element ranges from zero or so to two or so, the optical transmission factor of liquid crystal is relatively high under a relatively low temperature. In a low gradation region (i.e., gradation close to black) where the pulse width of a voltage that is applied to a liquid crystal element ranges from 25 or so to 32 or so, the optical transmission factor of liquid crystal does not increase so much as temperature increases.

Focusing attention on the medium gradation region where the pulse width of a voltage that is applied to a liquid crystal element ranges from, for example, three inclusive to 24 inclusive, the characteristic curve for each of exemplary temperature set of 40° C., 50° C., and 60° C. has a linearity, or more exactly, a line pattern that is close thereto. Referring to the characteristic curve under the temperature of 40° C., which is taken as the basis of comparison/reference made herein, the optical transmission factor of liquid crystal is approximately 30% under an assumption that a voltage having the pulse width of 12 is applied to a liquid crystal element. In order to obtain the same optical transmission factor of liquid crystal as above, which is approximately 30%, a voltage having the pulse width of 14 should be applied to a liquid crystal element under 50° C. as the characteristic curve indicates. Under the temperature of 60° C., a voltage having the pulse width of 15 should be applied to a liquid crystal element in order to obtain the same optical transmission factor of approximately 30%. In other words, in the medium gradation range, it is possible to make temperature correction by increasing the number of the pulse width by two under 50° C., or by increasing the number of the pulse width by three under 60° C. This is true for the entire range of the medium gradation region because of its approximately linear pattern.

Figure 4:
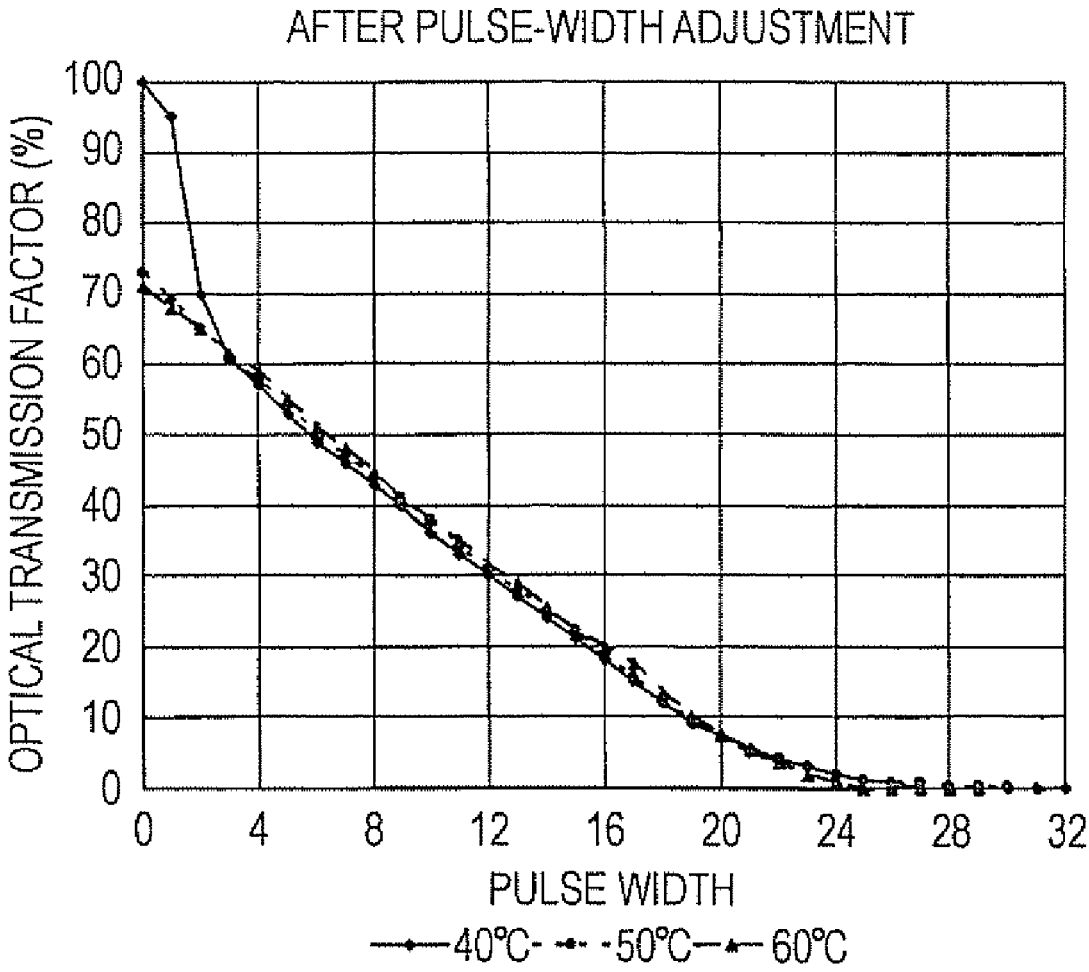
FIG. 4 is a graph that shows the relationship between the pulse width of a voltage that is applied to a liquid crystal element and the optical transmission factor of liquid crystal, which is shown for each of exemplary set of temperatures, after the application of correction according to an exemplary embodiment of the invention.

FIG. 4 is a graph that shows the relationship between the pulse width of a voltage that is applied to a liquid crystal element (60) and the optical transmission factor of liquid crystal, which is shown for each of exemplary temperature set of 40° C., 50° C., and 60° C. It should be noted that FIG. 4 shows characteristic curves obtained after the application of temperature correction according to an exemplary embodiment of the invention. This graph indicates that, in order to make temperature correction, as a correction value, the number of the pulse width is increased by two under 50° C., which is added to the number of the pulse width required under 40° C. (taken as a reference basis). Under the temperature of 60° C., in order to make temperature correction, the number of the pulse width is increased by the correction value of three over the number of the pulse width required under 40° C. As understood from this graph, it is possible to adjust the characteristic curves of the exemplary temperature set of 40° C., 50° C., and 60° C. with one another so as to obtain a uniform curve pattern in the medium gradation range by means of the above-described temperature correction according to an exemplary embodiment of the invention. However, in the high and low gradation ranges, the graph indicates that the resultant curve patterns after temperature correction are not satisfactorily uniform. Especially, in the high gradation region, the difference in characteristics among these exemplary temperatures is larger after temperature correction in comparison with that before temperature correction. In view of such a fact, in the present embodiment of the invention, temperature correction is performed while compensating for such a gradation-region-based difference. A more detailed explanation thereof will be given later.

Figures 5, 6:
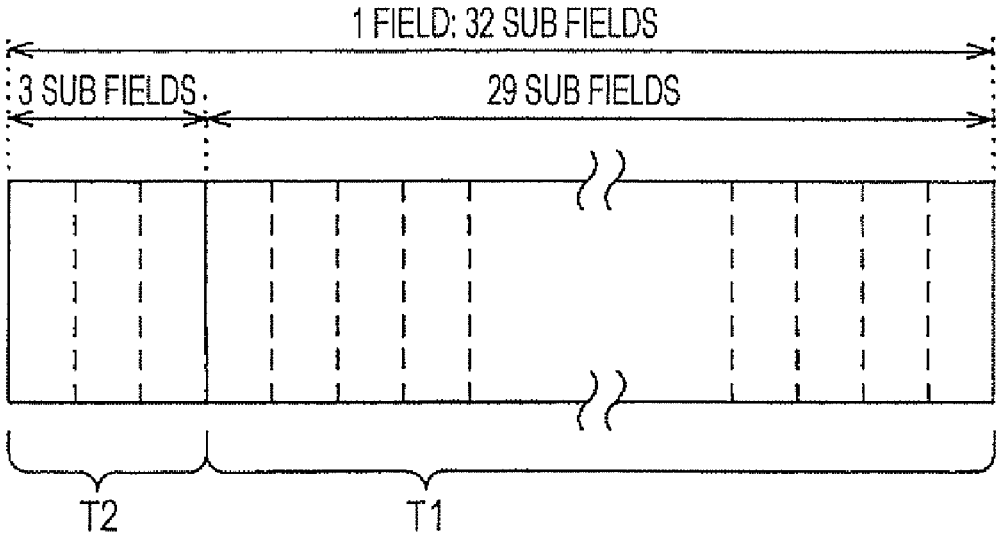
FIG. 5 is a diagram that illustrates the data configuration of a sub-field data according to an exemplary embodiment of the invention.
FIG. 6 is a diagram that shows an example of a temperature characteristic correction sub-field table that pre-stores correction data that is to be set in the temperature-characteristic sub fields.

FIG. 5 is a diagram that illustrates the data configuration of a sub-field data according to the present embodiment of the invention. As illustrated in the drawing, in the data configuration of a sub-field data according to the present embodiment of the invention, one field is equi-partitioned into 32 sub fields in such a manner that each thereof has the same sub-field length as that of other. Twenty-nine sub fields that follow the remaining three sub fields constitute a first time period T1. The remaining three sub fields constitute a second time period T2. Each of three sub fields that belong to the second time period T2 functions as a temperature-correction sub field. On the other hand, each of twenty-nine sub fields that belong to the first time period T1 functions as an image-display sub field. For example, an eight-bit image signal is converted into the above-mentioned 29 image-display sub fields. It should be noted that it is not necessary to provide an individual lookup table for each temperature in order to make such a conversion; that is, it is just enough if a lookup table is prepared on the basis of a standard characteristic. The correction of characteristic for each temperature is performed by means of the temperature-correction sub fields (i.e., temperature-characteristic sub fields).

FIG. 6 is a diagram that shows an example of a temperature characteristic correction sub-field table that pre-stores correction data that is to be set in the temperature-characteristic sub fields. As illustrated in FIG. 6, a temperature characteristic correction sub-field table 142 is a table that pre-stores temperature correction data that is to be set in the temperature characteristic correction sub fields in a matrix of gradation ranges and temperatures.

In the illustrated example, temperature correction data is set as "000", "011", and "111" in temperatures 40° C., 50° C., and 60° C. in the medium gradation range, respectively. That is, the temperature characteristic correction sub-field table 142 illustrated therein indicates that the number of pulse width is increased by two under 50° C. as an addition to the data sub fields that are converted with reference to the lookup table. In addition, the temperature characteristic correction sub-field table 142 illustrated therein indicates that the number of pulse width is increased by three under 60° C. as an addition to the data sub fields that are converted with reference to the lookup table.

On the other hand, in the illustrated example, temperature correction data is set as "011", "001", and "000" in temperatures 40° C., 50° C., and 60° C. in the high gradation range, respectively. That is, the temperature characteristic correction sub-field table 142 illustrated therein indicates that the number of pulse width is increased by two under 40° C. as an addition to the data sub fields that are converted with reference to the lookup table. In addition, the temperature characteristic correction sub-field table 142 illustrated therein indicates that the number of pulse width is increased by one under 50° C. as an addition to the data sub fields that are converted with reference to the lookup table. Since the difference in temperature characteristics is very small even without correction in the low gradation range, temperature correction data is set as "000" for each of temperatures 40° C., 50° C., and 60° C., which means that no pulse-width correction is conducted therein.

As explained above, in the present embodiment of the invention, temperature characteristics are corrected by means of dedicated temperature-correction sub fields. Therefore, it is not necessary to prepare an individual lookup table for each temperature, thereby making it possible to reduce memory capacity. In addition, since correction values are set while taking gradation-range characteristics into consideration, it is possible to enhance the precision of correction. It should be noted that, needless to say, each of the number of sub fields, the number of temperature characteristic correction sub fields, and the number of image display sub fields is a mere example. The scope of the invention should be in no case understood to be limited to such a specific example. The set of values that is preset in the temperature characteristic table is nothing more than an example. These values may be arbitrarily set in accordance with the characteristics of liquid crystal that is used in the actual implementation of the invention. The number of gradation regions is not limited to three. It may be greater than or less than three so as to match the characteristics of liquid crystal that is used in the actual implementation of the invention.

Figure 7:
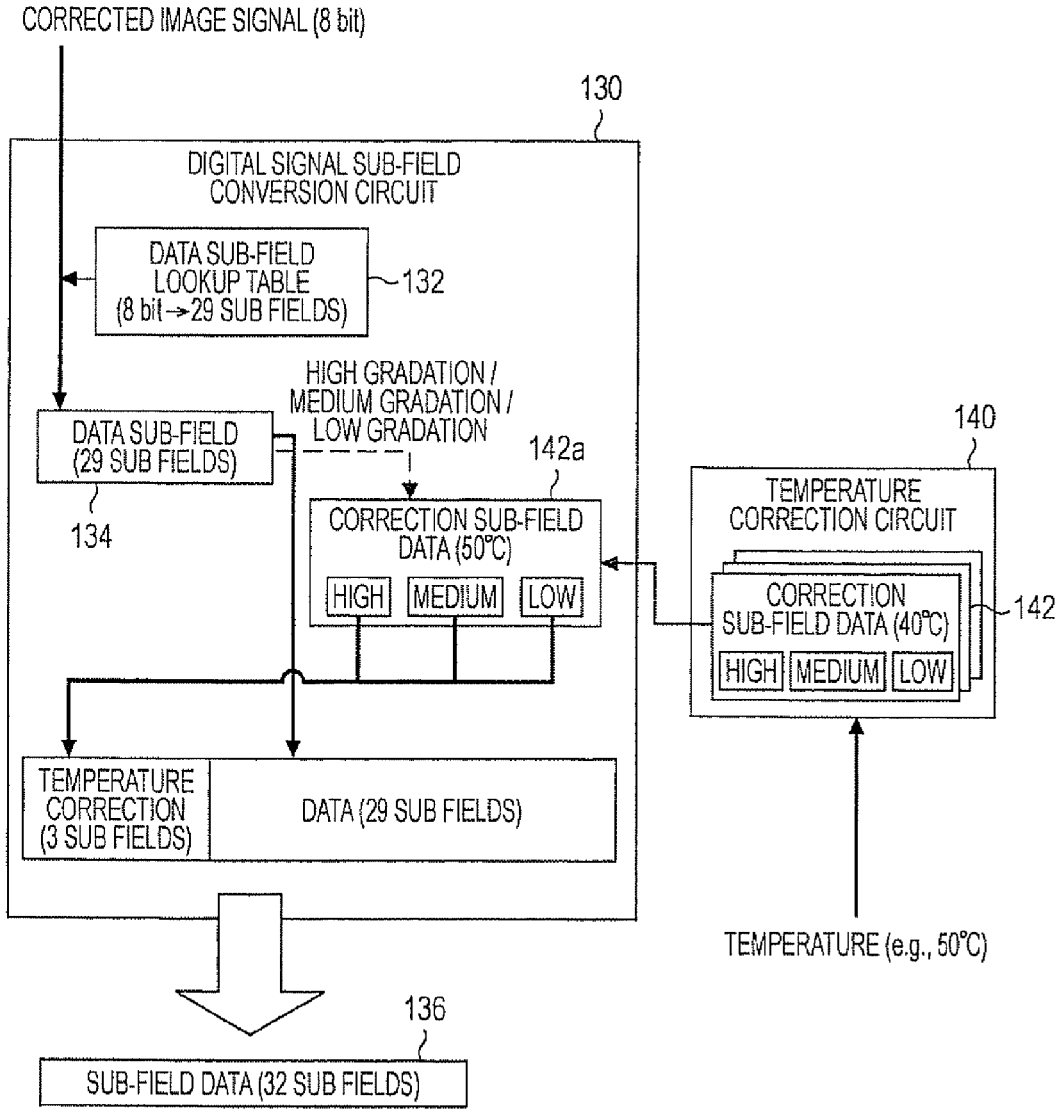
FIG. 7 is a diagram that schematically illustrates an example of the processing flow of temperature correction according to an exemplary embodiment of the invention.

Next, with reference to FIG. 7, the processing flow of temperature correction according to the present embodiment of the invention is explained below. In the illustrated example, it is assumed that the temperature of the liquid crystal panel 110 is 50° C.

The temperature correction circuit 140 can refer to the temperature characteristic correction sub-field table 142 that is stored either inside or outside thereof. The temperature correction circuit 140 supplies correction sub-field data that corresponds to the acquired temperature data to the digital signal sub-field conversion circuit 130. In this example, the temperature correction circuit 140 supplies the correction sub-field data 142*a* for the measured/acquired temperature of 50° C. to the digital signal sub-field conversion circuit 130. The correction sub-field data 142*a* contains a set of a high-gradation-region correction value, a medium-gradation-region correction value, and a low-gradation-region correction value that corresponds to the measured/acquired temperature. Unless the temperature of the liquid crystal panel 110 changes, it is possible to continue to use the same correction sub-field data 142*a*. That is, unless the temperature of the liquid crystal panel 110 changes, it is not necessary to supply the same correction sub-field data 142*a* redundantly to the digital signal sub-field conversion circuit 130.

Upon reception of an 2-bit corrected image signal from the image processing circuit 120, the digital signal sub-field conversion circuit 130 refers to a lookup table 132 so as to convert it into a data sub field 134 that is made up of twenty-nine sub fields. At this time, a judgment is made so as to identify the gradation range to which the gradation of an image signal that is to be displayed belongs, which is the high gradation range, the medium gradation range, or the low gradation range. The judgment can be made on the basis of a predetermined criterion.

Figure 8:
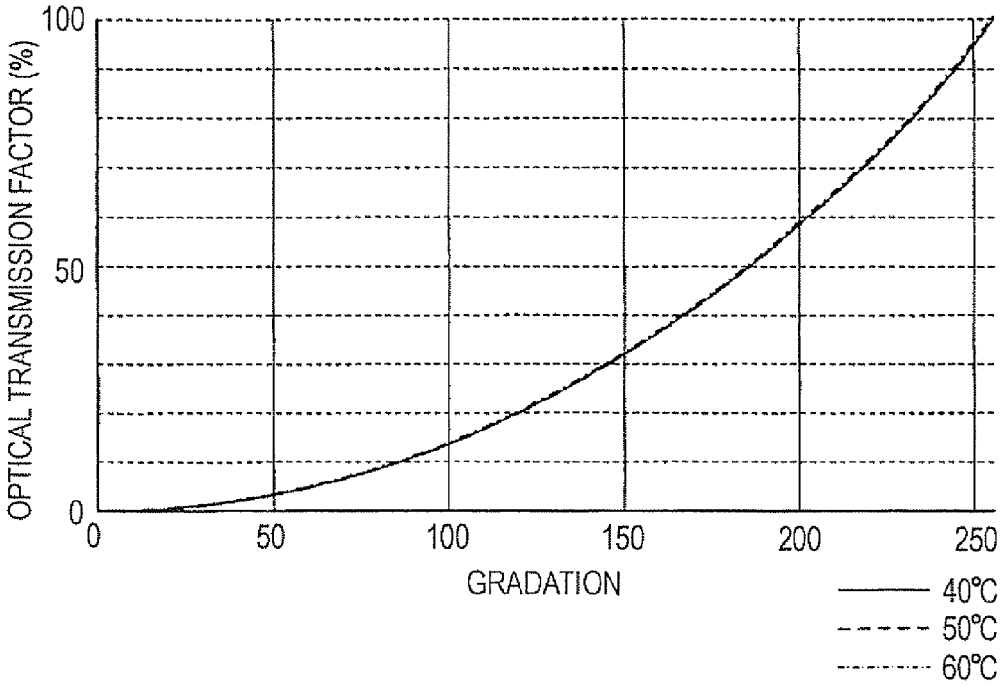
FIG. 8 is a graph that illustrates an example of the characteristics of liquid crystal, specifically, the relation between gradation and optical transmission factor thereof under a plurality of temperature conditions after correction according to an exemplary embodiment of the invention.

The digital signal sub-field conversion circuit 130 refers to the correction sub-field data 142*a* that has been supplied from the temperature correction circuit 140 so as to acquire correction data that corresponds to the gradation range to which the gradation of an image signal that is to be displayed belongs. The acquired correction data constitute the temperature-characteristic sub fields. Then, the digital signal sub-field conversion circuit 130 combines the acquired temperature-characteristic sub fields, which contain three sub fields, and the data sub fields 134, which contain twenty-nine sub fields, so as to make up a combined sub-field data 136, which is made up of thirty-two sub fields. Thereafter, the digital signal sub-field conversion circuit 130 supplies the sub-field data 136 to the aforementioned data-line driver 113. The liquid crystal panel 110 performs display on the basis of the sub-field data 136. By this means, as illustrated in a graph of FIG. 8 that shows the relationship between gradation and optical transmission factor for each of exemplary temperature set of 40° C., 50° C., and 60° C., it is possible to offer a uniform display with corrected temperature characteristics for all gradations.

In the data configuration according to an exemplary embodiment of the invention, it is explained that the second time period T2 is placed at the head of one field. However, the invention is not limited to such a data configuration. That is, the second time period T2 may be placed at the tail thereof. As another modification example, the temperature-correction sub fields may be spread/dispersed, that is, placed not as a sequence, within the first time period T1. In such a modified data configuration, a group of the temperature-correction sub fields that are placed not as a sequence inside the first time period T1 can be recognized to constitute the second time period T2.

2. Electronic Apparatuses

Figure 9:
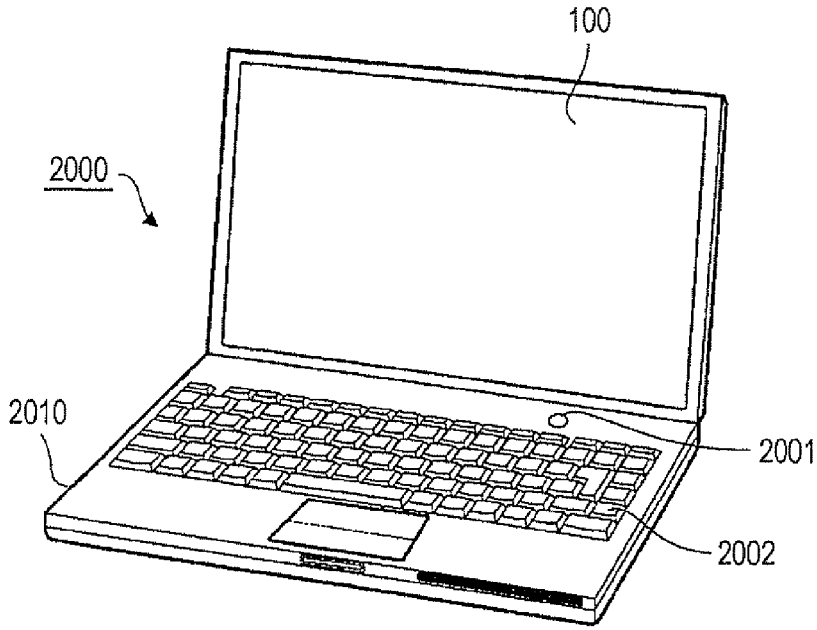
FIG. 9 is a perspective view that schematically illustrates an example of the configuration of a mobile personal computer (a non-limiting example of a variety of electronic apparatuses) that adopts, as its display device, a liquid crystal device according to an exemplary embodiment of the invention.

Next, an explanation is given below of a few non-limiting examples of a variety of electronic apparatuses to which the liquid crystal device 100 according to an exemplary embodiment of the invention described above is applicable. FIG. 9 is a perspective view that schematically illustrates an example of the configuration of a mobile personal computer that adopts, as its display device, the liquid crystal device 100 according to any of the exemplary embodiments of the invention, including variation/modification examples thereof, described above. A personal computer 2000 has the liquid crystal device 100, which functions as the display device thereof, and a main assembly 2010. The main assembly 2010 is provided with a power switch 2001 and a keyboard 2002.

Figure 10:
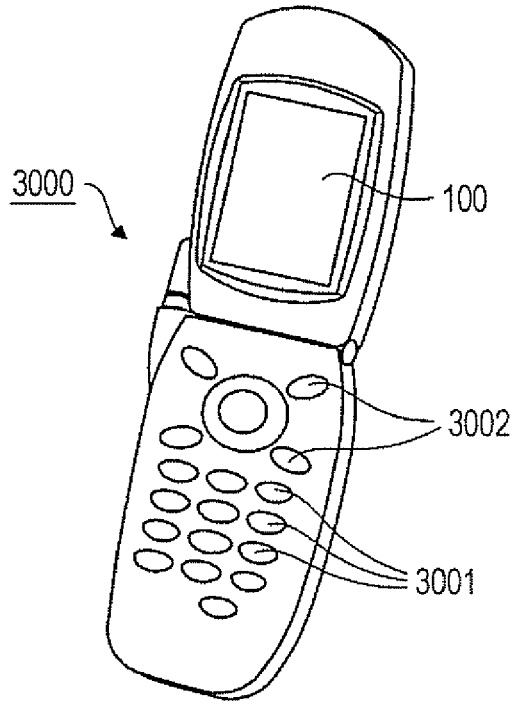
FIG. 10 is a perspective view that schematically illustrates an example of the configuration of a mobile phone (a non-limiting example of a variety of electronic apparatuses) that adopts, as its display device, a liquid crystal device according to an exemplary embodiment of the invention.

FIG. 10 is a perspective view that schematically illustrates an example of the configuration of a mobile phone that adopts, as its display device, the liquid crystal device 100 according to any of the exemplary embodiments of the invention, including variation/modification examples thereof, described above. A mobile phone 3000 is provided with a plurality of manual operation buttons 3001, scroll buttons

3002, and the liquid crystal device 100 functioning as a display device thereof. As a user manipulates the scroll buttons 3002, content displayed on the screen of the liquid crystal device 100 is scrolled.

Figure 11:
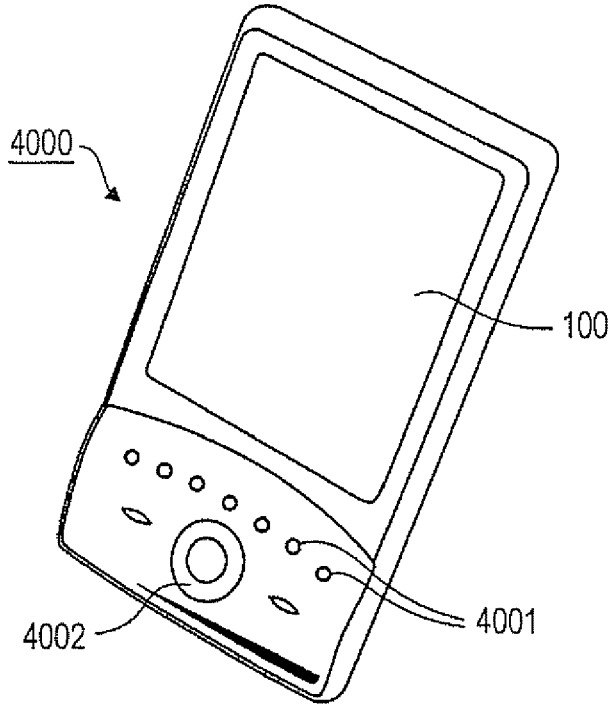
FIG. 11 is a perspective view that schematically illustrates an example of the configuration of a personal digital assistant (a non-limiting example of a variety of electronic apparatuses) that adopts, as its display device, a liquid crystal device according to an exemplary embodiment of the invention.
Figure 12:
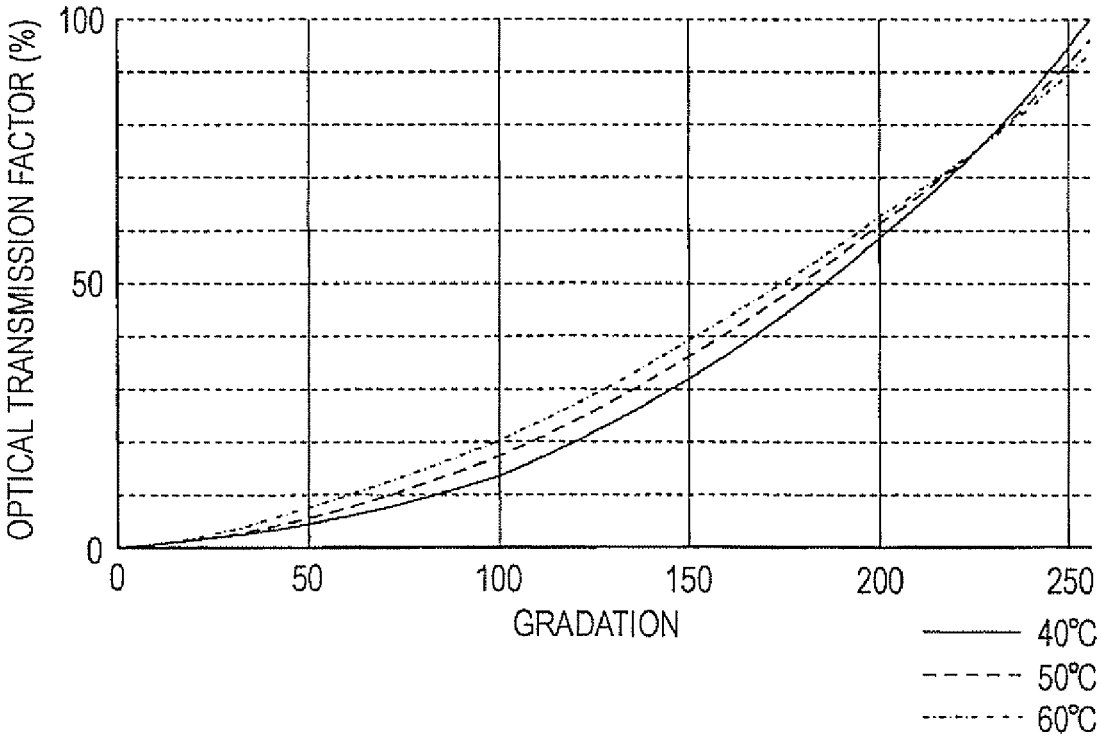
FIG. 12 is a graph that illustrates an example of the characteristics of liquid crystal, specifically, the relation between gradation and optical transmission factor thereof under a plurality of temperature conditions before correction according to an exemplary embodiment of the invention.

FIG. 11 is a perspective view that schematically illustrates an example of the configuration of a personal digital assistant (PDA) that adopts, as its display device, the liquid crystal device 100 according to any of the exemplary embodiments of the invention, including variation/modification examples thereof, described above. A personal digital assistant 4000 is provided with a plurality of manual operation buttons 4001, a power switch 4002, and the liquid crystal device 100 functioning as a display device thereof. As a user manipulates the power switch 4002, various kinds of information including but not limited to an address list or a schedule table is displayed on the liquid crystal device 100.

Among a variety of electronic apparatuses to which the liquid crystal device according to the present invention is applicable are, other than the specific examples illustrated in FIGS. 9-11, a projector, a television, a video camera, a car navigation device, a pager, an electronic personal organizer, an electronic paper, an electronic calculator, a word processor, a workstation, a videophone, a POS terminal, a printer, a scanner, a copier, a video player, a touch-panel device, and so forth.

The entire disclosure of Japanese Patent Application No. 2007-076109, filed Mar. 23, 2007 is expressly incorporated by reference herein.

What is claimed is:

1. A display device that performs gradation display by means of a sub-field driving scheme, the display device comprising:

a display area in which a plurality of pixels is arrayed, the display device controlling an ON/OFF state for each of the plurality of pixels for each of a plurality of sub fields that make up one field, each sub-field having an equal time period, one part of the plurality of sub-fields constituting a first time period, the remaining part of the plurality of sub fields constituting a second time period;

a first storing section that pre-stores, for each of the sub fields that belong to the first time period, a gradation that is to be displayed and an ON/OFF state of the pixel in association with each other;

a first converting section that looks up the first storing section so as to convert an image signal that indicates a gradation that is to be displayed into a first sub-field data that specifies an ON/OFF state of the pixel for each of the sub fields that belong to the first time period;

a temperature-data acquiring section that acquires a temperature of the display area;

a second storing section that pre-stores, for each of the sub fields that belong to the second time period, a temperature of the display area and an ON/OFF state of the pixel in association with each other;

a second converting section that looks up the second storing section so as to convert the temperature acquired by the temperature-data acquiring section into a second sub-field data that specifies an ON/OFF state of the pixel for each of the sub fields that belong to the second time period;

a combining section that combines the first sub-field data and the second sub-field data so as to generate a combined sub-field data that specifies an ON/OFF state for each of the plurality of sub fields that make up one field; and a driving section that controls an ON/OFF state for each of the plurality of pixels for each of the plurality of sub fields on the basis of the combined sub-field data.

* * * * *